United States Patent [19]

Utter

[11] Patent Number: 4,934,910

[45] Date of Patent: Jun. 19, 1990

[54] SCROLL-TYPE FLUID APPARATUS WITH RADIALLY COMPLIANT DRIVING MEANS

[75] Inventor: Robert E. Utter, Onalaska, Wis.

[73] Assignee: American Standard, Inc., New York, N.Y.

[21] Appl. No.: 195,289

[22] Filed: Oct. 8, 1980

[51] Int. Cl.[5] ..... F01C 1/04; F01C 17/06

[52] U.S. Cl. ..... 418/55; 418/57; 418/151

[58] Field of Search ..... 418/55, 57, 151, 14

[56] References Cited

U.S. PATENT DOCUMENTS

| | | | |
|---|---|---|---|
| 1,890,572 | 12/1932 | Dubrovin | 418/151 |
| 3,434,656 | 3/1969 | Bellmer | 417/371 |
| 3,924,977 | 12/1975 | McCullough | 418/55 |
| 3,986,799 | 10/1976 | McCullough | 418/57 |
| 3,994,636 | 11/1976 | McCullough et al. | 418/55 |
| 4,065,279 | 12/1977 | McCullough | 418/55 |

FOREIGN PATENT DOCUMENTS

| | | | |
|---|---|---|---|
| 54-139107 | 10/1979 | Japan | 418/55 E |
| 55-60684 | 5/1980 | Japan | 418/14 |
| 55-96390 | 7/1980 | Japan | 418/55 R |

*Primary Examiner*—John J. Vrablik

*Attorney, Agent, or Firm*—Peter D. Ferguson; William J. Beres

[57] ABSTRACT

Fluid apparatus of the scroll-type are disclosed wherein radially compliant means effect relative orbital motion between first and second wrap elements such that actual moving line contact occurs between their flank surfaces, and wherein linkage means interconnect one of the wrap elements and crankshaft means such that a component of the force acting therebetween is imposed upon the wrap element in a radially outward direction in order to provide a sealing or contact force between the wrap elements. Counterweight means impose a force upon the wrap element in a radially inward direction which is substantially equal to the centrifugal force experienced thereby, whereby the contact force is made independent of the operating speed of the apparatus and self-compensating with respect to pressure conditions therein.

29 Claims, 4 Drawing Sheets

SCROLL-TYPE FLUID APPARATUS WITH RADIALLY COMPLIANT DRIVING MEANS

DESCRIPTION

TECHNICAL FIELD

The present invention relates generally to the field of scroll-type fluid apparatus including compressors, pumps, and expansion engines; and is specifically directed to scroll-type apparatus wherein radially compliant means permit actual moving line contact between the flank surfaces of intermeshing wrap elements. The particular problem addressed by the invention is that of maintaining a proper sealing force between the wrap elements under conditions of variable operating speed and pressure conditions.

BACKGROUND ART

In the field of positive displacement fluid apparatus, there exists a class or category generally referred to as scroll-type fluid apparatus which are characterized by the provision of wrap elements defining flank surfaces of generally spiroidal configuration about respective axes, which wrap elements lie in intermeshing, angularly offset relationship with their axes generally parallel such that relative orbital motion between the wrap element results in the formation of one or more moving volumes between the wrap elements, defined by moving lines of coaction between the wrap elements at which their flank surfaces lie substantially tangent to each other. In a preferred form, the precise shape of the generally spiroidal flank surfaces comprise an involute of a circle, however, the term "generally spiroidal" is intended to encompass any form providing the requisite moving volumes during relative orbital motion between the wrap elements. Typically, end plate means are provided in sealing relationship to the wrap elements as they undergo relative orbital motion such that the moving volumes are effectively sealed. Reference may be had to U.S. Pat. No. 801,182 for an early disclosure of scroll-type fluid apparatus embodying this principle, or to U.S. Pat. No. 3,884,599 for a more recent disclosure.

It has been recognized that scroll-type fluid apparatus having utility in a wide variety of applications, including gas compressors or vacuum pumps for elevating the pressure of a gaseous working fluid; liquid pumps for transporting a liquid working fluid; or as an expansion engine for producing mechanical work by the expansion of a relatively high pressure gaseous working fluid. In the case of a gas compressor, the moving volumes defined between wrap elements originate at a radially outer portion thereof and progress inwardly while their volume is reduced, resulting in compression of the working gas which is then discharged at a radially inner portion of the wrap elenents. Liquid pumps function in a similar fashion with the wrap elements configured such that no appreciable reduction in volume occurs as the volumes progress radially inwardly, while scroll-type expansion engines receive a relatively high pressure gaseous working fluid at the radially inner portion of their wrap elements, which then progresses radially outwardly in the moving volumes as they increase in volume, resulting in expansion of the working fluid and production of mechanical work.

In considering the kinematic relationship necessary in order to effect the requisite relative orbital motion between the wrap elements, it should be noted that at least three general approaches exist:

(1) maintaining one wrap element fixed while orbiting the other with respect thereto, i.e., causing it to undergo circular translation while maintaining a fixed angular relationship between the wrap elements;

(2) orbiting both wrap elements in opposite directions while maintaining a fixed angular relationship therebetween; and (3) rotating both wrap elements about offset, parallel axes while maintaining a fixed angular relationship therebetween.

A second consideration relevant to the relative orbital motion between wrap elements is the manner in which their flank surfaces are permitted to coact with each other; i.e., is actual contact permitted therebetween along the lines at which the surfaces lie substantially tangent, accompanied by a radial sealing force therebetween; or are constraints imposed thereon so as to maintain a slight clearance or gap therebetween. In this regard, it is convenient to term the former as "radially compliant" type, while the latter may be referred to as "fixed-crank" type. As used herein, the term "moving line coaction" is intended to be descriptive of both types, while the term "actual moving line contact" is limited to the radially compliant type. Reference may be had to U.S. Pat. No. 3,924,977 for disclosure of a radially compliant type drive mechanism, while U.S. Pat. No. 4,082,484 is illustrative of the fixed-crank type.

The present invention is directed to scroll type fluid apparatus of the radially compliant type wherein a contact or sealing force acts between the wrap elements at their lines of contact, and addresses the problem of maintaining a suitable sealing force while the apparatus experience variable speed operating conditions as well as variable pressure conditions.

U.S. Pat. No. 3,934,977 discloses scroll-type fluid apparatus wherein radially compliant mechanical linking means are provided which include a variety of means including springs, counterweights, and configurations for controlling the radial sealing force between wrap elements. In addressing the problem of controlling the sealing force under conditions of variable operating speed, patentee suggests at column 14, lines 14–18, that a counterweight may be provided which counterbalances all of the centrifugal force experienced by the orbiting scroll member, while mechanical springs provide the desired sealing force. The patentee further discloses in FIG. 20 a configuration in which the orientation of the axis of the linking means is varied in order to affect the radial sealing force, permitting the use of a smaller counterweight.

DISCLOSURE OF THE INVENTION

The present invention, as discussed briefly above, addresses the problem of maintaining a proper sealing or contact force between the flank surfaces of first and second wrap elements in scroll-type apparatus which include drive means of the radially compliant type and may be subject to variable operating speeds. This is accomplished by directing a component of the drive force acting between a crankshaft and an orbiting wrap element or scroll member in a radially outward direction in a sense to provide a sealing or contact force, while counterweight means are provided to impose a force upon the orbiting wrap element or scroll manner which is substantially equal in magnitude and opposite in direction to the centrifugal force experienced by the orbiting wrap element or scroll member. Thus, the contact force is rendered substantially independent of variations in operating speed of the compressor, and is maintained at a suitable level in response to increased operating conditions of the apparatus as the drive force increases.

In preferred embodiments, linkage means interconnect a crankshaft and an orbiting scroll member and comprise a linkage member rotatably engaging a stub shaft or crank pin of the crank shaft and the orbiting scroll member such that a component of the drive force acting therebetween is directed radially outwardly, and the linkage member itself has a mass so-positioned and of a magnitude as to counterbalance the centrifugal force experienced by the orbiting scroll member.

Accordingly, it is a primary object of the present invention to provide scroll-type fluid apparatus capable of variable speed operation and wherein the sealing or contact force between wrap elements is not affected thereby.

A further, attendant, object of the invention is to provide a sealing or contact force which is self-compensating; i.e., one which is maintained at a suitable level in response to increased pressure operating conditions in the apparatus, while remaining independent of change in operating speed.

Related to these objects, it is an object that the means or elements utilized in carrying out the invention be simple and reliable in nature, as to provide fluid apparatus which is inexpensive yet capable of rugged duty and long operating life.

These and other objects of the invention will become apparent from the detailed description of preferred embodiments which follows, and by reference to the accompanying drawings.

BRIEF DESCRIPTION OF THE DRAWINGS

FIG. 7*a* is an enlarged view of element 22 of the first embodiment of the invention illustrating a configuration in which the linkage member pushes the orbiting scroll thereby placing the linkage member in compression.

FIG. 8*a* is an enlarged view of element 30 of the second embodiment of the invention illustrating a configuration in which the linkage member pushes the orbiting scroll thereby placing the linkage member in compression.

BEST MODE FOR CARRYING OUT THE INVENTION

Figure 1:
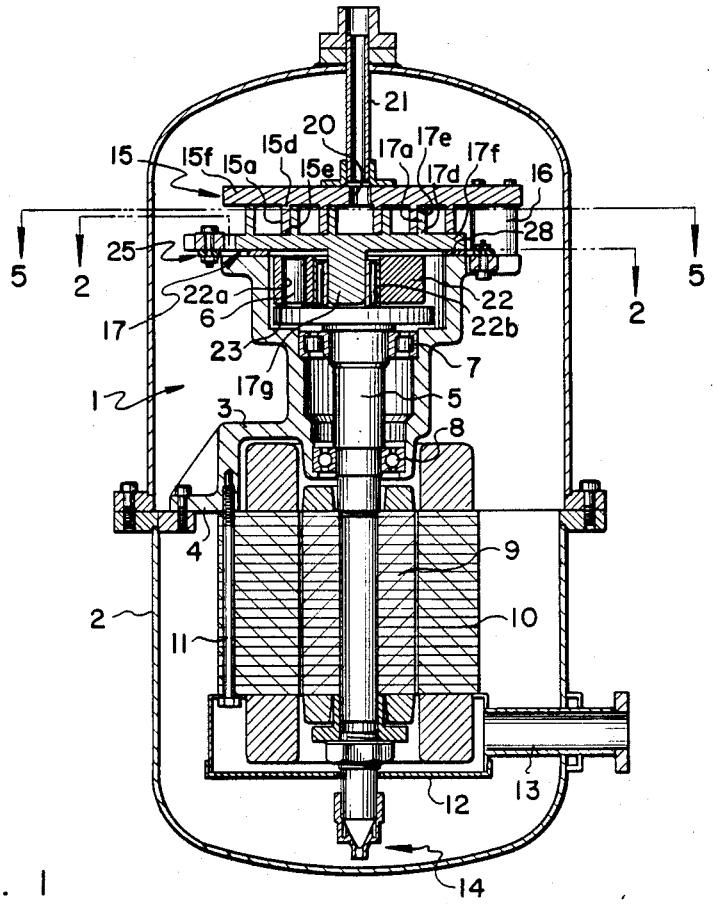
FIG. 1 is a vertical cross-sectional view of a first embodiment of the invention, taken along line 1—1 of FIG. 2.

Turning to FIG. 1, fluid apparatus of the positive displacement scroll type are illustrated in the form of a gas compressor indicated generally by reference numeral 1, and disposed within a hermetic casing or shell 2. A crankcase housing 3 includes a plurality of supporting legs 4 which are suitably affixed to the inner periphery of shell 2 so as to support the compressor therein.

Crankshaft means are rotatably supported within housing 3 and include a shaft 5 rotatable on a shaft axis and crank means 6 in the form of a crank pin or stub shaft affixed thereto and radially offset therefrom along a crank axis. In the embodiment illustrated in FIG. 1, shaft 5 is supported by an upper roller bearing assembly 7 and a lower ball bearing assembly 8, which bearings also serve to support any axial loads imposed upon shaft 5 due to the shoulders machined on shaft 5 and housing 3, as shown.

An electric drive motor includes a rotor 9 affixed to the lower end of shaft 5 and a stator 10 fastened to housing 3 by a plurality of bolts 11. Surrounding the lower end of stator 10 is a shroud 12 for receiving gas to be compressed from inlet conduit 13 and directing same over the drive motor for cooling purposes.

The lowermost end of shaft 5 includes a centrifugal oil pump, indicated generally by reference numeral 14, which pumps oil from a sump in the lower portion of shell 2, via one or more axial passages in shaft 5, to the various components of the compressor requiring lubrication. Since the particulars of the lubrication system do not form a part of the present invention, nor is an understanding thereof critical to the invention, no detailed explanation thereof is believed warranted. Reference may be had to U.S. Pat. No. 4,064,279 for an example of this type lubrication system.

Figure 5:
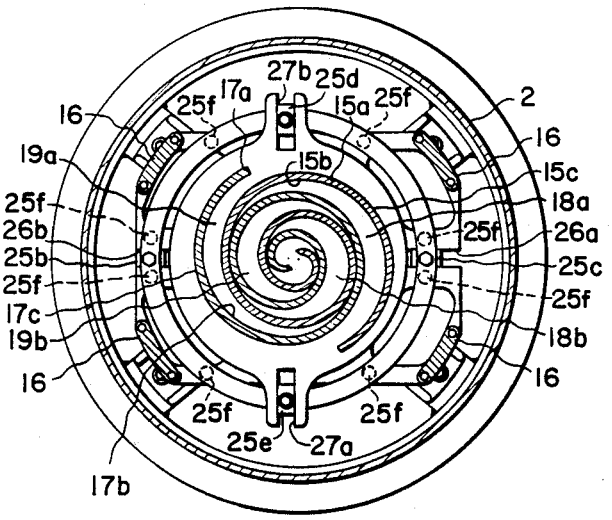
FIG. 5 is a cross-sectional view taken along line 5≦5 of FIG. 1.

Affixed to the upper portion of housing 3 is a fixed, or second, scroll member indicated generally at 15 and comprising a second wrap element 15*a* which, as best seen in FIG. 5, defines respective inner and outer flank surfaces 15*b* and 15*c* of generally spiroidal configuration about a second axis and extending between a first axial tip portion 15*d* and a second axial tip portion 15*e*. Scroll member 15 further includes end plate means in overlying, substantially sealing relationship to axial tip portion 15*d* and, in the embodiment illustrated, comprise an end plate 15*f* sealingly affixed to axial tip portion 15*d*. Scroll member 15, including wrap element 15*a* and end plate 15*f*, may be machined from a single casting or block of material; or, in the alternative, wrap element 15*a* may be formed separately and then suitably attached to end plate 15*f*. By reference to FIGS. 1 and 2, it can be seen that end plate 15*f* is attached to housing 3 by four column members 16 spaced about its periphery.

An orbiting, or first scroll member indicated generally at 17 includes a first wrap element 17*a* which, as best seen in FIG. 5, defines respective inner and outer flank surfaces 17*b* and 17*c* of generally spiroidal configuration about a first axis and extending between a first axial tip portion 17*d* and a second axial tip portion 17*e*. Scroll member 17 also includes end plate means in overlying, substantially sealing relationship to axial tip portion 17*d* and, in the embodiment illustrated, comprise a first end plate 17*f* sealingly affixed to axial tip portion 17*d*. Scroll member 17 may be fabricated using those techniques outlined with respect to scroll member 15.

Figure 9:
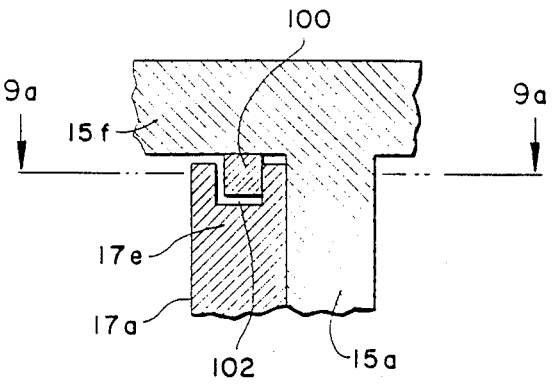
FIG. 9 is a cross sectional view of a tip seal arrangement as might be employed in the present invention.
Figure 9A:
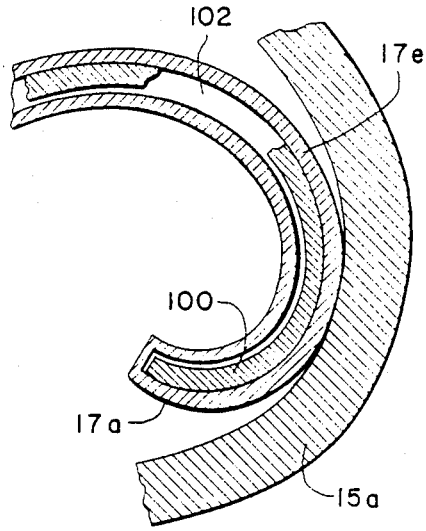
FIG. 9*a* is a view taken along lines 9*a*—9*a* of FIG. 9.

From FIGS. 1 and 5, it can be seen that first and second wrap elements 17*a* and 15*a*, respectively, are disposed in intermeshing, angularly offset relationship with their axes generally parallel, and such that second axial tip portions 17*e* and 15*e* extend to positions in substantial sealing relationship with end plates 15*f* and 17*f*, respectively. Illustrated in FIGS. 9 and 9*a* is an exemplary tip seal, many varieties of which are disclosed in U.S. Pat. No. 3,994,636. It will be appreciated, in referring concurrently to FIGS. 9 and 9*a* and to U.S. Pat. No. 3,994,636, that tip seal 100 is disposed in a slot 102 milled into, for example, axial tip portion 17*e* of wrap 17*a* and that the tip seal 100 is biased, as by pressure developed in the moving volumes between the flank surfaces of scroll wraps 15*a* and 17*a* or by mechanical means such as those illustrated in U.S. Pat. No. 3,994,636, into contact with the opposing end plate 15*f*. In this manner, compressor performance is improved through the reduction of leakage therein.

By reference to FIG. 5, it can be seen that wrap elements 15*a* and 17*a* define a first series of moving volumes 18*a*, 18*b* between flank surfaces 15*b* and 17*c*; and a second series of moving volumes 19*a*, 19*b* between flank surfaces 17*b* and 15*c*; which volumes progress radially inwardly as wrap element 17*a* orbits with respect to wrap element 15*a* in a counterclockwise direction as viewed in FIG. 5. Volumes 18*a*, 19*a* comprise suction volumes bounded by a single, leading line of contact, while volumes 18*b*, 19*b* are bounded by both leading and trailing lines of contact and are reduced in volume as wrap element 17*a* undergoes orbital motion until the volumes are bounded by only a trailing line of contact and the compressed gas is discharged via port 20 and discharge conduit 21.

Thus, compressor 1 receives gas to be compressed from conduit 13 after it has passed over the drive motor as previously described, which gas enters volumes 18*a*, 19*a* from about the periphery of wrap elements 15, 17, and is discharged therefrom via port 20 and conduit 21.

Figure 2:
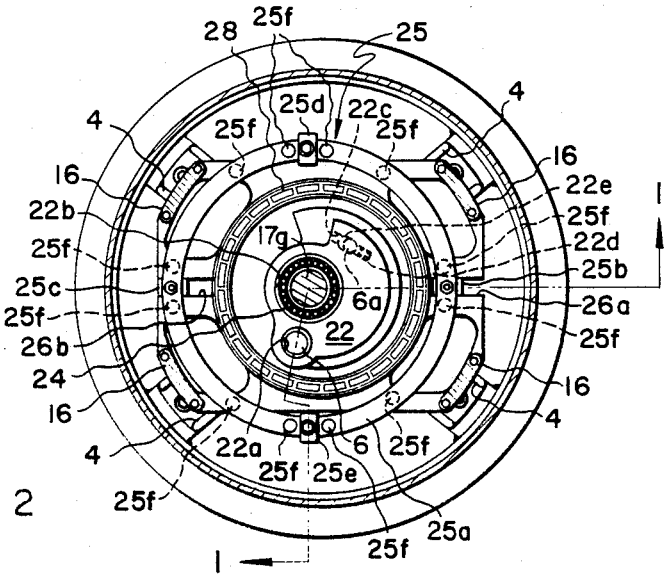
FIG. 2 is a cross-sectional view taken along line 2—2 of FIG. 1.

In order to impart orbiting motion to scroll member 17, radially compliant drive means are provided such that actual moving line contact is permitted between the flank surfaces of wrap elements 15*a* and 17*a*, and a sealing force acts therebetween. As shown in FIGS. 1 and 2, such means include linkage means operatively interconnecting shaft 5 and wrap element 17*a* via its attached end plate 17*f*, which linkage means comprise a linkage member 22 having a bore 22*a*, rotatably engaging stub shaft 6 of crankshaft 5; and a bore 22*b* rotatably engaging a stub shaft 17*g* depending from end plate 17*f* along a third axis. Suitable bearing means such as journal bearing 23 between bore 22*a* and stub shaft 6; and needle roller bearing 24 between bore 22*b* and stub shaft 17*g* are provided as shown. It may be noted that bore 22*a* lies wholly outside bore 22*b*, and that both bores extend completely through linkage member 22.

From FIG. 2 it can be seen that stub shaft 17*g* of scroll member 17 is free to undergo at least limited motion in a radial direction with respect to the axis of shaft 5 as linkage member 22 pivots or swings about the axis of stub shaft 6, thereby permitting actual line contact between the flank surfaces of wrap elements 17*a* and 15*a*. It can further be seen that, upon rotation of shaft 5, scroll member 17 will undergo orbital motion with respect to fixed scroll member 15.

Linkage member 22 further includes a bore 22*c* containing a spring 22*d*; and an axial bore 22*e* which receives a pin 6*a* affixed to shaft 5. When compressor 1 is at rest, spring 22*d* urges scroll member 17 in a radially inward direction so as to provide a clearance between the flank surfaces of wrap elements 15*a* and 17*a*, thereby reducing the initial torque required at start-up.

In order to maintain a fixed angular relationship between scroll members 15 and 17 and their associated wrap elements 15*a*, 17*a*; means are provided in the form of an Oldham coupling 25 which includes a circular ring 25*a* having a first pair of blocks 25*b*, 25*c* which are pivotally mounted thereto and slideably engage slots 26*a*, 26*b* in the upper portion of housing 3. A second pair of blocks 25*d*, 25*e* are likewise pivotally mounted to ring 25*a* and slideably engage slots 27*a*, 27*b* in end plate 17*f* (see FIG. 5). In this manner, orbiting scroll member 17 is restrained from angular displacement while permitted to undergo circular translation with a variable circular orbit radius. Ring 25*a* is further provided with a plurality of pads 25*f* which slideably engage surfaces machined on the upper portion of housing 3 and on orbiting scroll member 17. Reference may be had to U.S. Pat. No. 4,065,279 for disclosure of a similar Oldham coupling member.

Oribiting scroll member 17 is supported during its orbital motion by a thrust bearing 28 adequate to absorb the axial pressure forces to which scroll member 17 is subjected during operation. U.S. Pat. No. 4,065,279 also discloses one type of thrust bearing suitable for use in this application.

Figure 7:
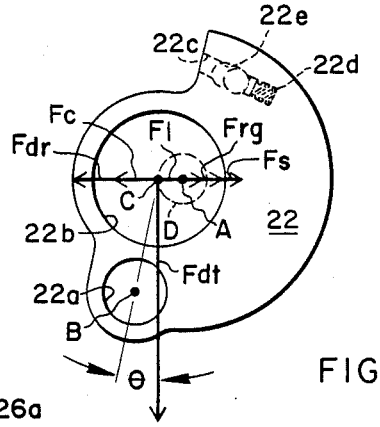
FIG. 7 is an enlarged view of element 22 of the first embodiment of the invention.

Turning now to FIG. 7, linkage member 22 has been illustrated in order to facilitate an understanding of the forces acting upon orbiting scroll member 17 during operation, point A denoting the axis of shaft 5, point B the axis of stub shaft 6, and point C the axis of stub shaft 17*g* affixed to orbiting scroll member 17. Thus, it can be visualized that line AB rotates about point A in a counterclockwise direction, while linkage member 22, acting along line BC, "pulls" orbiting scroll member 17 about a circular orbit path denoted at D. Orbiting scroll member 17 thus experiences a centrifugal force in a radially outward direction as illustrated at $F_c$, which force is proportional to its mass; while an oppositely directed force is imposed thereon due to the centrifugal force experienced by linkage member 22 which, in effect, rotates about point A. Linkage member 22 is configured so as to include counterweight means of a mass and so-positioned as to impose a force $F_1$ upon scroll member 17 which is substantially equal to force $F_c$; thus, the forces to which orbiting scroll member 17 are subjected are substantially independent of the operating speed of the compressor since $F_c$ and $F_1$ will always be equal and opposite.

Another force experienced by scroll member 17 is a radial gas force due to the pressures existing between the wrap elements during operation. This force, shown as $F_{rg}$, tends to separate the scroll members and must be overcome at all operating speeds so as to maintain a proper sealing or contact force between the wrap elements.

From FIG. 7, it can be seen that a drive force will act along line BC of linkage member 22, in a sense to place member 22 in tension, and that the drive force may be broken down into two components acting upon scroll member 17 due to the angle theta which line BC makes with respect to a line drawn through point C tangent to orbit path D. As shown, drive force $F_d$ includes a radially outwardly acting component $F_{dr}$ and a tangential component $F_{dt}$. Since $F_{dt}$ will vary with different operating conditions of the compressor, i.e., the suction and discharge pressures at which it operates, it follows that $F_{dr}$ will also vary accordingly. Since the radial gas force $F_{rg}$ will also vary with operating conditions, it becomes apparent that the angle theta must be selected such that $F_{dr}$ will always be greater than $F_{rg}$, resulting in a positive contact or sealing force $F_s$ acting between the scroll members. With this configuration, the contact or sealing force becomes self-compensating in response to changes in operating conditions; that is, upon an increase in operating conditions, the required driving force will increase, with a concomitant increase in its radial component $F_{dr}$ in order to overcome the corresponding increase in the radial gas force $F_{rg}$, thereby maintaining a positive contact force $F_s$, irrespective of changes in operating speed of the compressor.

Figure 3:
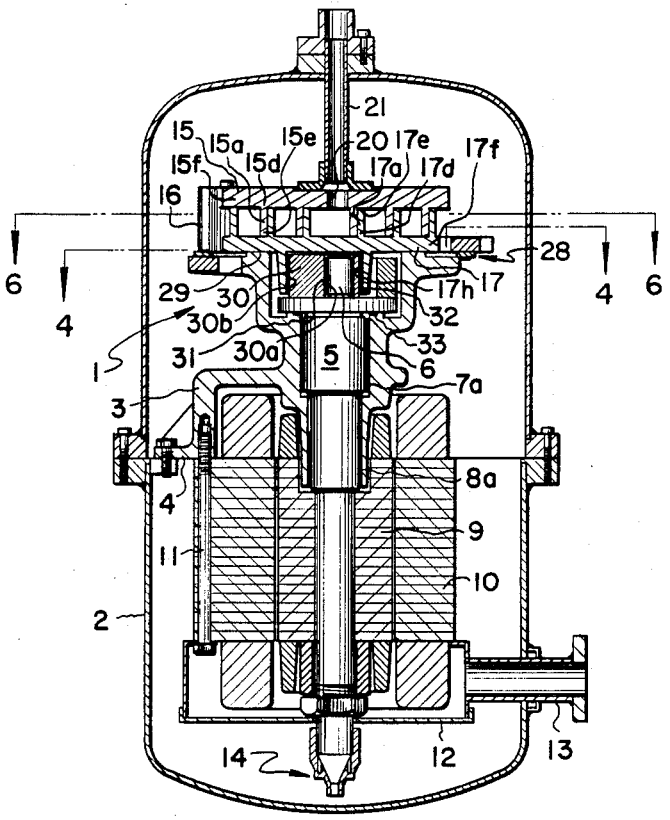
FIG. 3 is a vertical cross-sectional view of a second embodiment of the invention, taken along line 3—3 of FIG. 4.
Figure 4:
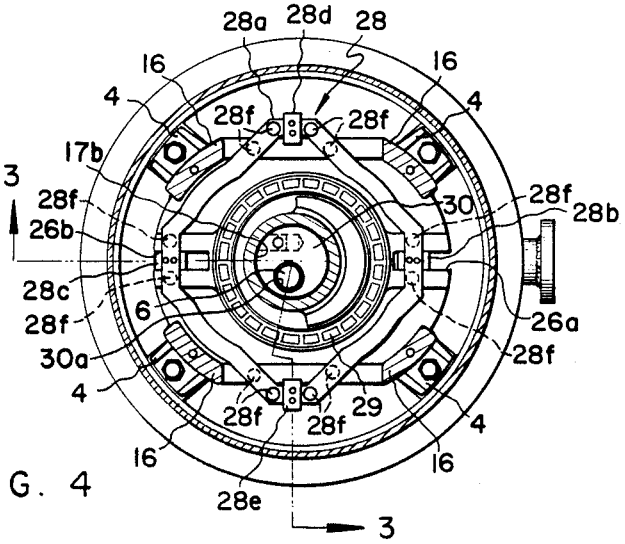
FIG. 4 is a cross-sectional view taken along line 4—4 of FIG. 3.

Turning next to FIGS. 3 and 4 of the drawings, a second embodiment of the invention is disclosed wherein like reference numerals have been used to identify elements corresonding or similar to those of the preceding embodiment. Generally, the embodiment of FIGS. 3 and 4 comprise a compressor 1 supported within shell 2, again including a housing 3 having shaft 5 supported for rotation therein by bearings 7*a* and 8*a* of the journal type, and further including a thrust bearing 33 for absorbing axial loads to which shaft 5 is subjected. As in the previous embodiment, a rotor 9 is affixed to a lower end of shaft 5, surrounded by stator 10 bolted to housing 3; with an oil pump generally indicated at 14 at its lowermost end.

Figure 6:
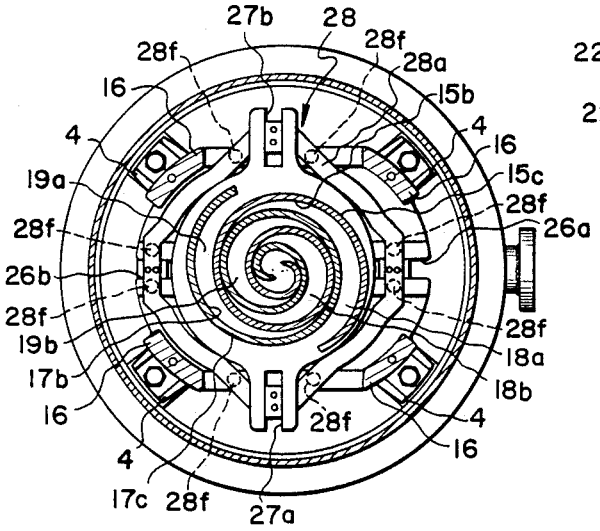
FIG. 6 is cross-sectional view taken along line 6—6 of FIG. 3.

A second, or fixed scroll member 15 and a first, or orbiting scroll member 17 are also provided which function substantially the same as previously described, as is apparent from a comparison of FIGS. 5 and 6. Orbiting scroll member 17 is supported by a thrust bearing 29 which may be conveniently machined on an upper surface of housing 3, while a modified Oldham coupling member 28 maintains a fixed angular relationship between scroll members 15 and 17 as in the previous embodiment. Coupling member 28 differs from member 25 of the previous embodiment principally in that blocks 28*b* through 28*e* are rigidly affixed thereto rather than being pivotally mounted, while pads 28*f* thereof are again slideable upon an upper surface of housing 3 and orbiting scroll member 17.

Figure 8:
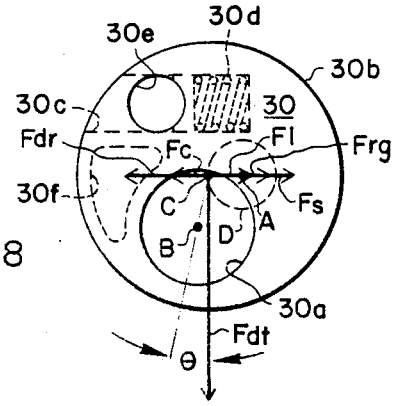
FIG. 8 is an enlarged view of element 30 of the second embodiment of the invention.

The embodiment of FIGS. 3 and 4 differs primarily in the configuration of linkage member 30 which rotatably engages crank pin or stub shaft 6 and wrap element 17*a* by way of its end plate 17*f*. As shown best in FIG. 4, linkage member 30 includes a first bore 30*a* engaging stub shaft 6, journal bearing 31 being disposed therebetween; while the outer cylindrical surface 30*b* thereof comprises a stub shaft in engagement with bore 17*h* of scroll member 17 which extends along a third axis, journal bearing 32 being disposed therebetween, it being noted that bore 30*a* lies wholly within bore 17*h*, and that it extends completely through linkage member 30. As best shown in FIG. 8, wherein points A, B, and C correspond kinematically to those of FIG. 7, linkage member 30 may be visualized as rotating about point A in a counterclockwise direction, effectively "pulling" orbiting scroll member 17 along line BC about its orbit path D. Since the force analysis with respect to FIG. 8 is identical to that of FIG. 7, no detailed repetition is believed necessary, it being clear that the angle theta permits a component of the drive force to act in a radially outward direction in order to provide a proper sealing force under variable operating conditions, while the mass of linkage member 30 is so-positioned and of a magnitude as to provide force $F_1$ which is substantially equal to the centrifugal force $F_c$ experienced by the orbiting scroll member, a void space 30*f* being provided in member 30 so as to properly orient its center of mass.

Linkage member 30 also includes a bore 30*c* having a spring 30*d* disposed therein; and a bore 30*e* which receives a pin 6*a* affixed to shaft 5. As before, spring 30*d* urges scroll member in a radially inward direction when the compressor is at rest, providing a gap or clearance between wrap elements 15*a*, 17*a* so as to reduce the torque required at start-up.

From the foregoing description of preferred embodiments of the present invention, it should be apparent that the objects of the invention set forth previously have been met. It should be expressly noted, however, that although the invention is described with respect to a gas compressor, it also would find application in scroll-type fluid apparatus of other types such as liquid pumps or expansion engines. In the case of an electric motor-driven compressor as shown, speed variations may be brought about through the use of two-speed motors, inverter or AC synthesizer frequency controls, or suitable mechanical variable speed drives. It is contemplated, however, that the invention would also have utility in those applications where a variable speed prime mover such as an internal combustion engine is used to drive a compressor, such as in an automobile or bus air conditioning system.

Moreover, variations in the invention might include different scroll member orbiting schemes, such as orbiting both scroll members in opposite directions; or the location of the drive means about the periphery of the scroll members rather than at their center. Similarly, the wrap elements could be of trapezoidal cross-section as shown, for example, in U.S. Pat. No. 1,041,721 rather than as shown.

Further modifications might include the provision of wrap elements on opposite sides of a common end plate, as shown in U.S. Pat. No. 3,011,694; or the provision of a wrap element having no end plate affixed thereto as shown in U.S. Pat. No. 1,376,291.

It should further be expressly noted that, while the linkage members of both preferred embodiments in FIGS. 7 and 8 are configured as noted above to "pull", the orbiting scroll member along line BC placing the linkage member in tension, it is possible to provide alternate configurations, as illustrated in FIGS. 7*a* and 8*a* in which points A, B and C; orbit path D; forces Fdr, Fc, Fl, Frg, Fs and Fdt; the angle theta; the features 22*a–e* of linkage member 22 and the features 30*a–f* of linkage member 30 all descriptively represent respectively the same points, path, forces, angle and features as set forth above with respect to FIGS. 7 and 8, such that the scroll member would be "pushed" and the linkage member placed in compression with a compression force acting along line BC having a component force Fdr which, like the embodiments of FIGS. 7 and 8, acts in a radially outward direction.

Thus, the scope of the invention is to be determined by reference to the claims which follow:

I claim:

1. Fluid apparatus of the positive displacement scroll type comprising a. a first wrap element defining at least an inner facing flank surface of generally spiroidal configuration about a first axis and extending between first and second axial tip portions;

b. a second wrap element defining at least an outer facing flank surface of generally spiroidal configuration about a second axis and extending between first and second axial tip portions, said first and second wrap elements being disposed in intermeshing, angularly offset relationship with their respective axes generally parallel;

c. end plate means in overlying, substantially sealing relationship to the first and second axial tip portions of said first and second wrap elements;

d. radially compliant means for effecting relative orbital motion between said first and second wrap elements such that actual moving line contact between the inner facing flank surface of said first wrap element and the outer facing flank surface of said second wrap element defines between said end plate means a moving volume which progresses from one of a radially outer and inner portion of said wrap elements to the other of said portions; said radially compliant means including;

i. crankshaft means including shaft means supported for rotation about a shaft axis parallel to said first and second axes and crank means affixed to said shaft means and radially offset therefrom;

ii. linkage means operatively interconnecting said crankshaft means and one of said first and second wrap elements such that rotation of said crankshaft means is accompanied by orbital motion of said one wrap element about said shaft axis and said one wrap element is free to undergo at least limited movement in a radial direction with respect to said shaft axis; said linkage means comprising a linkage member operatively connected to said crank means at a crank axis and to said one wrap element at a third axis substantially parallel to said crank and shaft axes such that a drive force acts along a first line extending between said crank axis and said third axis during orbital motion of said one wrap element, said first line making a predetermined angle with respect to a line drawn through said third axis tangent to the orbit path of said one wrap element such that the drive force has a component acting in a radially outward direction with respect to said shaft axis, whereby a sealing force is provided between the flank surfaces of said first and second wrap elements at their moving line contacts; said one wrap element and end plate including a stub shaft operatively affixed thereto and disposed along said third axis and said linkage member further including a bore in engagement with said stub shaft and wherein said crank axis lies outside said bore; and iii. counterweight means acting upon said one wrap element and rotatable with said crankshaft, said counterweight means having a mass so-positioned and of a magnitude as to impose a force upon said one wrap element in a radially inward direction with respect to said shaft axis which is substantially equal to the radially outward centrifugal force experienced by said one wrap element as it undergoes orbital motion, whereby the sealing force between said first and second wrap elements is substantially independent of the rotational speed of said crankshaft means; and e. fluid port means for admitting a working fluid to said moving volume adjacent said one of the radially outer and inner portions of said wrap elements, and for discharging same adjacent the other of said portions.

2. The fluid apparatus of claim 1 further comprising:

f. an electric drive motor for rotating said crankshaft means; and g. a hermetic shell for encasing said first wrap element, said second wrap element, said end plate means, said radially compliant means, said fluid port means, and said motor.

3. The fluid apparatus of claim 1, further comprising:

f. tip seal means disposed on each of said second axial tip portions of said first and second wrap elements to reduce leakage between said second axial tip portions and said end plate means.

4. The fluid apparatus of claim 1, further comprising:

f. journal-type thrust bearing means having intersecting lubricant grooves, said thrust bearing means supporting said one wrap element during orbital motion.

5. The fluid apparatus of claim 1, said linkage member defining a void space so as to properly orient the center of mass of said linkage member.

6. The fluid apparatus of claim 1, said driving force acting between said crank axis and said third axis placing said linkage member in tension along said first line.

7. The fluid apparatus of claim 6 further comprising:

f. an electric drive motor for rotating said crankshaft means; and g. a hermetic shell for encasing said first wrap element, said second wrap element, said end plate means, said radially compliant means, said fluid port means, and said motor.

8. The fluid apparatus of claim 7 wherein said electric drive motor is suction gas cooled.

9. The fluid apparatus of claim 7 wherein the speed of said electric drive motor is variable.

10. Fluid apparatus of the positive displacement scroll type comprising a. a first wrap element defining at least an inner facing flank surface of generally spiroidal configuration about a first axis and extending between first and second axial tip portions;

b. a second wrap element defining at least an outer facing flank surface of generally spiroidal configuration about a second axis and extending between first and second axial tip portions, said first and second wrap elements being disposed in intermeshing, angularly offset relationship with their respective axes generally parallel;

c. end plate means in overlying, substantially sealing relationship to the first and second axial tip portions of said first and second wrap elements;

d. radially compliant means for effecting relative orbital motion between said first and second wrap elements such that actual moving line contact between the inner facing flank surface of said first wrap element and the outer facing flank surface of said second wrap element defines between said end plate means a moving volume which progresses from one of a radially outer and inner portion of said wrap elements to the other of said portions; said radially compliant means including i. crankshaft means including shaft means supported for rotation about a shaft axis parallel to said first and second axes and crank means affixed to said shaft means and radially offset therefrom;

ii. linkage means operatively interconnecting said crankshaft means and one of said first and second wrap elements such that rotation of said crankshaft means is accompanied by orbital motion of said one wrap element about said shaft axis and said one wrap element is free to undergo at least limited movement in a radial direction with respect to said shaft axis; said linkage means comprising a linkage member operatively connected to said crank means at a crank axis and to said one wrap element at a third axis substantially parallel to said crank and shaft axes such that a drive force acts along a first line extending between said crank axis and said third axis during orbital motion of said one wrap element, said first line making a predetermined angle with respect to a line drawn through said third axis tangent to the orbit path of said one wrap element such that the drive force has a component acting in a radially outward direction with respect to said shaft axis, whereby a sealing force is provided between the flank surfaces of said first and second wrap elements at their moving line contacts; and iii. counterweight means acting upon said one wrap element and rotatable with said crankshaft, said counterweight means having a mass so-positioned and of a magnitude as to impose a force upon said one wrap element in a radially inward direction with respect to said shaft axis which is substantially equal to the radially outward centrifugal force experienced by said one wrap element as it undergoes orbital motion, whereby the sealing force between said first and second wrap elements is substantially independent of the rotational speed of said crankshaft means; and e. fluid port means for admitting a working fluid to said moving volume adjacent said one of the radially outer and inner portions of said wrap elements, and for discharging same adjacent the other of said portions;

said linkage member rotatably engaging said one wrap element at a third axis and said counterweight means comprising said linkage member and having a mass so-positioned and of a magnitude as to impose a force upon said one wrap element in a radially inward direction with respect to shaft axis which is substantially equal to the radially outward centrifugal force experienced by said one wrap element as it undergoes orbital motion;

said one wrap element including one of a first bore and stub shaft operatively affixed thereto and disposed along said third axis, and said linkage member further including the other of said first bore and stub shaft in engagement therewith;

said crank axis lying outside said first bore.

11. The fluid apparatus of claim 10 wherein said crank means comprise a second stub shaft and said linkage member includes a second bore in engagement therewith, and said one wrap element includes said first stub shaft operatively affixed thereto and in engagement with said first bore in said linkage member; said second bore lying wholly outside said first bore.

12. The fluid apparatus of claim 11 further comprising bearing means between said first and second stub shafts and bores, respectively.

13. The fluid apparatus of claim 11 wherein said first and second bores each extend completely through said linkage member.

14. The fluid apparatus as in any of claims 10–13 further comprising means for maintaining a fixed angular relationship between said first and second wrap elements.

15. The fluid apparatus as in any of claims 10–13 wherein the force acting between said crank axis and said third axis places said linkage member in tension along said first line.

16. A gas compressor of the positive displacement scroll type comprising a. a first wrap element defining inner and outer flank surfaces of generally spiroidal configuration about a first axis and extending between first and second axial tip portions, and a first end plate sealingly affixed to the first axial tip portion thereof;

b. a second wrap element defining inner and outer flank surfaces of generally spiroidal configuration about a second axis and extending between first and second axial tip portions, and a second end plate sealingly affixed to the first axial tip portion thereof; said first and second wrap elements being disposed in intermeshing, angularly offset relationship with their respective axes generally parallel, with the second axial tip portions of said first and second wrap elements extending to a point in substantial sealing relationship to said second and first end plates, respectively;

c. means for maintaining said second wrap element and end plate in a fixed position;

d. radially compliant means for driving said first wrap element and end plate in an orbital path with respect to said second wrap element and end plate such that actual moving line contact between the inner flank surface of said first wrap element and the outer flank surface of said second wrap element, and between the outer flank surface of said first wrap element and the inner surface of said second wrap element, defines between said first and second end plates, a plurality of moving volumes which are reduced in volume as they progress from a radially outer portion of said wrap elements to a radially inner portion thereof; said radially compliant means including i. crankshaft means including shaft means supported for rotation about a shaft axis parallel to said first and second axes and crank means affixed to said shaft means and radially offset therefrom;

ii. linkage means connected between said crankshaft means and said first wrap element and end plate such that rotation of said crankshaft means drives said first wrap element and end plate in an orbital path about said shaft axis while permitting at least limited movement thereof in a radial direction with respect to said shaft axis; said linkage means comprising a linkage member connected to said crank means at a crank axis and to said first wrap element and end plate at a third axis substantially parallel to said crank and shaft axes such that a drive force acts along a first line extending between said crank axis and said third axis during orbital motion of said first wrap element and end plate, said first line making a predetermined angle with respect to a line drawn through said third axis tangent to the orbit path of said first wrap element and end plate such that the drive force has a component acting in a radially outward direction with respect to said shaft axis, whereby a sealing force is provided between the flank surfaces of said first and second wrap elements at their lines of contact; and iii. counterweight means acting upon said first wrap element and end plate and rotatable with said crankshaft means, said counterweight means having a mass so-positioned and of a magnitude as to impose a force upon said first wrap element and end plate in a radially inward direction with respect to said shaft axis which is substantially equal to the radially outward centrifugal force experienced by said first wrap element and end plate as they undergo orbital motion, whereby the sealing force between the flank surfaces of said first and second wrap elements at their lines of contact is substantially independent of the speed at which said crankshaft means is rotated; and e. fluid port means for admitting a gas to be compressed adjacent the radially outer portions of said wrap elements and for discharging compressed gas adjacent the radially inner portions thereof;

said linkage member rotatably engaging said crank means at its crank axis and said counterweight means comprising said linkage member having a mass so-positioned and of a magnitude as to impose a force upon said first wrap element and end plate in a radially inward direction with respect to said shaft axis which is substantially equal to the radially outward centrifugal force experienced by said first wrap element and end plate as they undergo orbital motion;

said first wrap element and end plate including one of a first bore and stub shaft operatively affixed thereto and disposed along said third axis, and said linkage member further including the other of said first bore and stub shaft in engagement therewith;

said crank axis lying outside said first bore.

17. The compressor of claim 16 wherein said crank means comprise a second stub shaft and said linkage member includes a second bore in engagement therewith, and said first wrap element and end plate include said first stub shaft in engagement with said first bore in said linkage member; said second bore lying wholly outside said first bore.

18. The compressor of claim 17 comprising bearing means between said first and second stub shafts and bores, respectively.

19. The compressor of claim 17 wherein said first and second bores each extend completely through said linkage member.

20. The compressor as in any of claims 16–19 wherein said crankshaft means comprise a single crankshaft extending along a shaft axis substantially centrally disposed with respect to said first and second wrap elements and end plates.

21. The compressor as in any of claims 16–19 wherein said linkage member includes a mass of material disposed generally circumferentially about said shaft axis on a side thereof radially opposite from said third axis.

22. The compressor as in any of claims 16–19 further comprising means for maintaining a fixed angular relationship between said first wrap element and end plate and said second wrap element and end plate.

23. The compressor as in any of claims 16–19 wherein said drive force acting between said crank axis and said third axis places said linkage member in tension along said first line.

24. Fluid apparatus of the positive displacement scroll type comprising a. a first wrap element defining at least an inner facing flank surface of generally spiroidal configuration about a first axis and extending between first and second axial tip portions;

b. a second wrap element defining at least an outer facing flank surface of generally spiroidal configuration about a second axis and extending between first and second axial tip portions, said first and second wrap elements being disposed in intermeshing, angularly offset relationship with their respective axes generally parallel;

c. end plate means in overlying, substantially sealing relationship to the first and second axial tip portions of said first and second wrap elements;

d. radially compliant means for effecting relative orbital motion between said first and second wrap elements such that actual moving line contact between the inner facing flank surface of said first wrap element and the outer facing flank surface of said second wrap element defines between said end plate means a moving volume which progresses from one of a radially outer and inner portion of said wrap elements to the other of said portions; said radially compliant means including i. crankshaft means including shaft means supported for rotation about a shaft axis parallel to said first and second axes and crank means affixed to said shaft means and radially offset therefrom;

ii. linkage means operatively interconnecting said crankshaft means and one of said first and second wrap elements such that rotation of said crankshaft means is accompanied by orbital motion of said one wrap element about said shaft axis and said one wrap element is free to undergo at least limited movement in a radial direction with respect to said shaft axis; said linkage means comprising a linkage member operatively connected to said crank means at a crank axis and to said one wrap element at a third axis substantially parallel to said crank and shaft axes such that a drive force acts along a first line extending between said crank axis and said third axis during orbital motion of said one wrap element, said first line making a predetermined angle with respect to a line drawn through said third axis tangent to the orbit path of said one wrap element such that the drive force has a component acting in a radially outward direction with respect to said shaft axis, whereby a sealing force is provided between the flank surfaces of said first and second wrap elements at their moving line contacts; and iii. counterweight means acting upon said one wrap element and rotatable with said crankshaft, said counterweight means having a mass so-positioned and of a magnitude as to impose a force upon said one wrap element in a radially inward direction with respect to said shaft axis which is substantially equal to the radially outward centrifugal force experienced by said one wrap element as it undergoes orbital motion, whereby the sealing force between the first and second wrap elements is substantially independent of the rotational speed of said crankshaft means; and e. fluid port means for admitting a working fluid to said moving volume adjacent said one of the radially outer and inner portions of said wrap elements, and for discharging same adjacent the other of said portions;

said driving force acting between said crank axis and said third axis placing said linkage member in compression along said first line.

25. The fluid apparatus of claim 24, said one wrap element and end plate including a stub shaft operatively affixed thereto and disposed along said third axis and said linkage member further including a bore in engagement with said stub shaft and wherein said crank axis lies outside said bore.

26. The fluid apparatus of claim 24, said one wrap element and end plate means including a bore disposed along said third axis and said linkage member further including a stub shaft comprising a cylindrical surface of said linkage member in engagement with said bore and wherein said crank axis lies inside said bore.

27. The fluid apparatus of claim 24 further comprising:

f. an electric drive motor for rotating said crankshaft means; and g. a hermetic shell for encasing said first wrap element, said second wrap element, said end plate means, said radially compliant means, said fluid port means, and said motor.

28. The fluid apparatus of claim 25 further comprising:

f. an electric drive motor for rotating said crankshaft means; and g. a hermetic shell for encasing said first wrap element, said second wrap element, said end plate means, said radially compliant means, said fluid port means, and said motor.

29. The fluid apparatus of claim 26 further comprising:

f. an electric drive motor for rotating said crankshaft means; and g. a hermetic shell for encasing said first wrap element, said second wrap element, said end plate means, said radially compliant means, said fluid port means, and said motor.

* * * * *

UNITED STATES PATENT AND TRADEMARK OFFICE

CERTIFICATE OF CORRECTION

PATENT NO. : 4,934,910

DATED : JUNE 19, 1990

INVENTOR(S) : ROBERT E. UTTER

It is certified that error appears in the above-identified patent and that said Letters Patent is hereby corrected as shown below:

In the Drawings:

Figures 7a and 8a were omitted. There should be five drawing sheets, including Figures 7a and 8a attached hereto.

"Sheet 1 of 4" should be --Sheet 1 of 5--

"Sheet 2 of 4" should be --Sheet 2 of 5--

"Sheet 3 of 4" should be --Sheet 3 of 5--

Omitted Figures 7a and 8a are attached hereto as --Sheet 4 of 5--

"Sheet 4 of 4" should be --Sheet 5 of 5--

UNITED STATES PATENT AND TRADEMARK OFFICE

CERTIFICATE OF CORRECTION

PATENT NO. : 4,934,910

DATED : JUNE 19, 1990

INVENTOR(S) : ROBERT E. UTTER

It is certified that error appears in the above-identified patent and that said Letters Patent is hereby corrected as shown below:

Sheet 4 of 5

FIG 7a

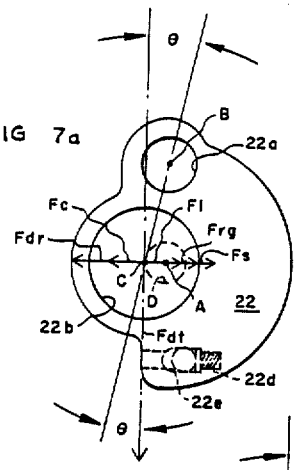

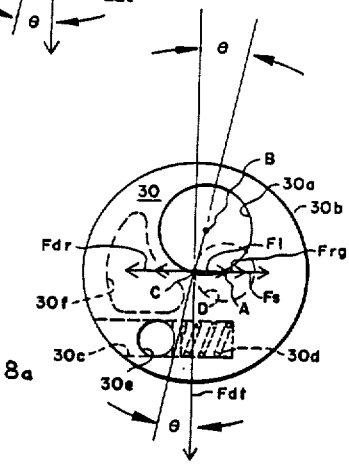

FIG 8a

UNITED STATES PATENT AND TRADEMARK OFFICE

CERTIFICATE OF CORRECTION

PATENT NO. : 4,934,910

DATED : JUNE 19, 1990

INVENTOR(S) : ROBERT E. UTTER

It is certified that error appears in the above-identified patent and that said Letters Patent is hereby corrected as shown below:

Column 1, line 57 - "elenents" should be --elements--

Column 3, line 49 - "5≤5" should be --5-5--

Signed and Sealed this

Nineteenth Day of November, 1991

*Attest:*

HARRY F. MANBECK, JR.

*Attesting Officer*

*Commissioner of Patents and Trademarks*